US005527615A

United States Patent [19]

Kimura et al.

[11] Patent Number: 5,527,615

[45] Date of Patent: Jun. 18, 1996

[54] IMAGE RECEPTOR SHEET FOR THERMAL TRANSFER

[75] Inventors: Yasunori Kimura; Takeshi Yoshikawa; Hideaki Kumada; Motohiko Kashioka, all of Tokyo, Japan

[73] Assignee: Toyo Ink Manufacturing Co., Ltd., Tokyo, Japan

[21] Appl. No.: 377,681

[22] Filed: Jan. 26, 1995

Related U.S. Application Data

[63] Continuation of Ser. No. 186,133, Jan. 25, 1994, abandoned.

[30] Foreign Application Priority Data

Mar. 5, 1993 [JP] Japan ..... 5-044799

[51] Int. Cl.[6] ..... B41M 5/00

[52] U.S. Cl. ..... 428/421; 428/195; 428/422; 428/447; 428/532; 428/535; 428/537.5

[58] Field of Search ..... 428/195, 411.1, 428/532, 535, 537.5, 447, 421, 422

[56] References Cited

U.S. PATENT DOCUMENTS 5,106,669 4/1992 Talvalkar et al. ..... 428/195

FOREIGN PATENT DOCUMENTS 0228066 7/1987 European Pat. Off. ..... 428/195
0367149 5/1990 European Pat. Off. ..... 428/195

*Primary Examiner*—Pamela R. Schwartz
*Attorney, Agent, or Firm*—Wenderoth, Lind & Ponack

[57] ABSTRACT

An image receptor sheet for use in a thermal transfer method using a thermal transfer material having a thermal transfer layer composed mainly of a thermoplastic resin, which image receptor sheet comprises a substrate and an image receptor layer containing sucrose benzoate, exhibits excellent image-receiving performance and adhesion to a transferred image and which gives an image transfer product excellent in scratch resistance, abrasion resistance and outdoor weatherability.

4 Claims, 1 Drawing Sheet

IMAGE RECEPTOR SHEET FOR THERMAL TRANSFER

This application is a continuation of now abandoned application Ser. No. 08/186,133, filed Jan. 25, 1994.

BACKGROUND OF THE INVENTION

1. Field of the Invention

The present invention relates to an image receptor sheet for use in heat-melting thermal transfer. More specifically, it relates to an image receptor sheet for use in thermal transfer, which has the property of receiving thermal transfer images, patterns, characters, etc. (to be sometimes simply referred to as image(s) hereinafter), and which gives an image transfer product excellent in scratch resistance, abrasion resistance and weatherability.

2. Prior Art of the Invention

A heat-melting thermal transfer device is recently widely used in a facsimile machine, a word processor, a computer terminal printer, and the like since it has features in that it is noise-free because of its non-impact system, maintenance-free, less expensive, small in size and light in weight. A thermal transfer material is generally produced by forming a heat-melting ink layer composed mainly of a wax on one surface of a substrate formed of a thin plastic film such as a polyester film (e.g., polyethylene terephthalate or polyethylene naphthalate). An image is transferred as follows. While the above heat-melting ink layer is in contact with the surface of an image receptor such as general paper, part of the heat-melting ink is transferred to the image receptor by heating the other surface of the substrate, for example, by means of a thermal head.

With a recent progress in the automatization of factories and stores, thermal transfer materials are increasingly used in the fields of labels and barcodes, and image-recorded sheets (e.g., labels and barcodes) are increasingly required to have various resistances such as scratch resistance and abrasion resistance. For this purpose, there has been developed a thermal transfer material having a heat-melting ink layer (transfer layer) composed mainly of a resin, and various materials such as coated paper, synthetic paper and a plastic sheet have begun to be used as image receptors depending upon purposes. When the thermal transfer material having a heat-melting ink layer composed mainly of a resin is used, it is difficult to transfer the heat-melting ink to general paper. The above heat-melting ink layer can be transferred to synthetic paper or a plastic sheet, while the adhesion of the heat-melting ink layer to the synthetic paper or the plastic sheet is insufficient, and the heat-melting ink layer is easily peeled off when a Cellophane tape is attached and peeled.

As an image receptor which serves to improve the resistances of an image transfer product, JP-A-63-137892 discloses an image receptor sheet produced by forming a layer of a thermoplastic resin having a melting point of 135° C. or lower on a substrate. However, the thermoplastic resins disclosed in the Examples of JP-A-63-137892 are polyolefins having a melting point of 100° to 135° C. such as polyethylene, and the layers of these thermoplastic resins are hence poor in adhesion to a substrate other than paper, such as a polyethylene terephthalate film generally used as an OHP film. Further, these thermoplastic resins have relatively high melting points, and are therefore poor in adhesion to a transfer image when the transfer layer is formed of a resin-containing heat-melting ink layer.

JP-A-1-120389 discloses an image receptor sheet produced by forming an image receptor layer composed mainly of a lubricant and a thermoplastic resin having Tg of 50° to 100° C. on a substrate. However, when the lubricant is natural wax, synthetic wax or higher fatty acid metal salt, the image receptor layer is poor in surface gloss. Further, since the lubricant is poor in weatherability, the image receptor layer is liable to undergo oxidation or hydrolysis to deteriorate when the image transfer product is used outdoors, and the image transfer product sheet practically discolors or deteriorates in gloss.

For improving the image receptor sheet in the image receiving performance and adhesion to a transfer image, generally, a thermoplastic resin having a melting point or softening point of 100° C. or lower is used for forming the image receptor layer. Of such thermoplastic resins, generally, those having a sharp melting point are polymers having a low molecular weight (about 2,000 or less) or oligomers, and films formed of them show low film strength and have almost no weatherability. There is therefore a problem in practical use. That is, when an image transfer product including such an image receptor layer is used outdoors, the image receptor layer deteriorates in a short period of time. Thermoplastic resins which have no sharp melting point but show a softening point have tack (adhesion property) at a temperature between ordinary temperature (about 30° C.) and a temperature around their softening points. Therefore, when the image transfer product is used outdoors, the image receptor layer is softened to show tack due to an increase in temperature caused by sunlight. As a result, dust may adhere or soot may be adsorbed to make the image transfer product dark and dirty. Further, when the image receptor layer is formed of a thermoplastic resin having a softening point of 100° C. or higher, the image receptor sheet shows sufficient image-receiving performance or sufficient adhesion to a transfer image only when such high energy as will give an overload to a thermal head is charged to a thermal transfer material having a thermal transfer layer composed mainly of a resin. It has been therefore difficult to obtain a thermal transfer receptor sheet which exhibits sufficient image-receiving performance and adhesion, to a transferred image when used with a thermal transfer material having a transfer layer composed mainly of a heat-melting ink and which gives an image transfer product excellent in scratch resistance, abrasion resistance and outdoor weatherability.

SUMMARY OF THE INVENTION

It is an object of the present invention to provide an image receptor sheet for use in a thermal transfer method using a thermal transfer material having a thermal transfer layer composed mainly of a thermoplastic resin.

It is another object of the present invention to provide an image receptor sheet which exhibits excellent image-receiving performance and adhesion to a transferred image and which gives an image transfer product excellent in scratch resistance, abrasion resistance and outdoor weatherability.

According to the present invention, there is provided a thermal transfer image receptor sheet for use in a heat-melting thermal transfer method, which comprises a substrate and an image receptor layer formed on the substrate, the image receptor layer containing sucrose benzoate.

DETAILED DESCRIPTION OF THE INVENTION

Figure 1:
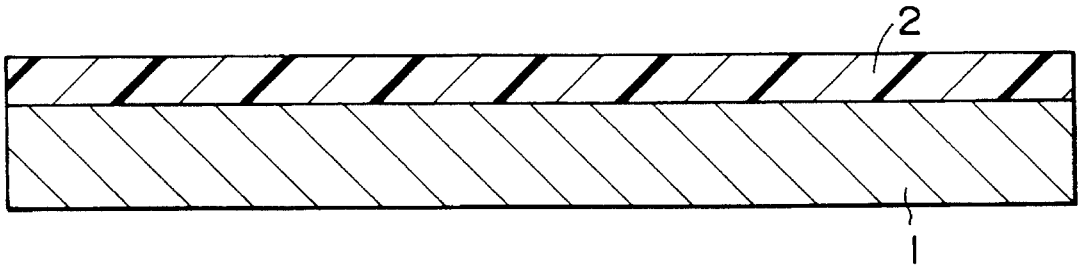
FIG. 1 is a cross-sectional view of a thermal transfer image receptor sheet of the present invention.
Figure 2:
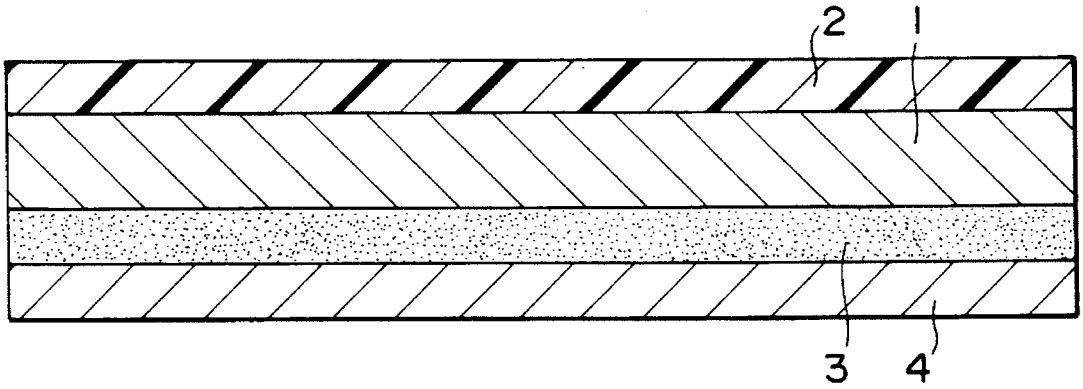
FIG. 2 is a cross-sectional view of a thermal transfer image receptor sheet of the present invention.

The surface of the thermal transfer image receptor sheet of the present invention and the transfer surface of a thermal transfer material (produced by forming a thermal transfer layer composed mainly of a resin on one surface of a substrate) are brought into contact with each other, and part of the thermal transfer layer is transferred onto the image receptor layer under heat and pressure of a thermal head applied to the other surface (substrate side) of the thermal transfer material, whereby there can be obtained a thermal transfer product which has an excellently transferred image and is excellent in the adhesion between the image receptor layer and the transferred thermal transfer layer, scratch resistance, abrasion resistance and weatherability, The present invention will be explained hereinafter with reference to the drawings. FIGS. 1 and 2 show the cross-sectional views of thermal transfer image receptor sheets of the present invention. The thermal transfer image receptor sheets of the present invention have a structure in which an image receptor layer is formed on a substrate such as a plastic sheet. Specifically, as shown in FIG. 1, an image receptor layer (2) containing sucrose benzoate is formed on a substrate (1). Further, as shown in FIG. 2, the thermal transfer image receptor sheet of the present invention may have a structure in which an adhesive layer (3) is formed on that surface of the substrate on which the image receptor layer is not formed and a peel layer (4) is provided on the adhesive layer.

Sucrose benzoate is a hard resinous substance having high crystallizability. The defect with sucrose benzoate is that its film formability is low, while it has features of excellent weatherability, a sharp melting point and excellent compatibility with other resin. Owing to these features, the above defect of low film formability can be overcome when an image receptor layer is formed from a mixture of sucrose benzoate with a thermoplastic resin having proper film formability. Not only the so-produced image receptor layer has excellent heat sensitivity, but also it prevents the surface of an image receptor product from being contaminated by the adherence of dust and soot, which contamination is mainly caused by the softening of the image receptor layer when the image transfer product is used outdoors as a display, etc. Sucrose benzoate is a compound in which 1 to 8 substituents derived from benzoic acids bond to sucrose, since sucrose has eight hydroxyl groups. The melting point of sucrose benzoate and the compatibility with other resin differ depending upon the number of substituted benzoic acids. In the present invention, preferred is sucrose benzoate which is an ester formed from one sucrose molecule and about eight benzoic acid molecules, since it exhibits a sharp and proper melting point (78° C.) and has compatibility with a wide range of other resins.

The thermoplastic resin used for forming the image receptor layer is not specially limited, while it is preferably selected from thermoplastic resins having film formability to some extent. These thermoplastic resins may be used alone or in combination. The amount of the thermoplastic resin in the image receptor layer is properly 1 to 99 % by weight, preferably 10 to 70% by weight. When a resin having a low softening point (about 50° C. or lower) or a resin having a high softening point (about 150° C. or higher) is used, it is preferred to use such a resin in a small amount. When the above amount is too large and when the softening point is low, the thermal transfer product is contaminated with dust and soot when used outdoors. When the above amount is too large and when the softening point is high, the image-receiving performance of the image receptor sheet may deteriorate.

The above thermoplastic resin includes polyvinyl chloride, polyvinyl acetate, a vinyl chloride-vinyl acetate copolymer, polyacetal, an ethylene-vinyl acetate copolymer, an ethylene-(meth)acrylate copolymer, a styrene(meth)acrylate copolymer, an acrylic resin, a polyamide resin, a cellulose derivative, a phenolic resin, an amino resin, a vinyl chloride-(meth)acrylate copolymer, a polyurethane resin, a polyester resin, polycaprolactone, chlorinated polyolefin, polycarbonate, styrene-butadiene rubber, polyvinyl butyral, nitrile rubber, acryl rubber, and ethylene-propylene rubber.

Further, for further improving the resistance to contamination outdoors, the image receptor layer may contain a fluorine-containing compound having a polyfluoro group or a silicone-modified resin having a polyorganosiloxane unit.

The fluorine-containing compound preferably includes a compound in which a side chain of an acrylic resin bonds to a main chain of a fluorine resin, a graft polymer (which may be a low molecular weight oligomer) in which a side chain of a fluorine resin bonds to a main chain of an acrylic resin, and a copolymer (which may be a low molecular weight oligomer) formed from a polyfluoro group-containing vinyl monomer and other vinyl monomer. The content of the fluorine-containing compound in the image receptor layer is properly 0 to 50% by weight depending upon the kind of the fluorine-containing compound, while it is preferably 1 to 20% by weight. When this content exceeds the above upper limit, the image-receiving performance may decrease.

The silicone-modified resin preferably includes polymers obtained by graft-modifying or block-modifying polyorganosiloxane as a main chain, and particularly preferred are a silicone-modified polyurethane resin obtained by an addition-reaction of a compound (or prepolymer) having at least two hydroxyl groups in the molecule, a polyoroganosiloxane having at least two hydroxy groups in the molecule and a compound (or prepolymer) having at least two isocyanate groups in the molecule; and a silicone-modified acrylic resin obtained by the polymerization of at least one acrylic monomer and polyoroganosiloxane having a radical-polymerizable double bond. When a conventionally known silicone oil is used, undesirably, a so-called exudation such as bleeding may take place to cause a failure in transfer and a decrease in intimate adhesion of a transfer image. In the present invention, the term "silicone-modified resin" refers to that which is a solid at room temperature.

The content of the polyoroganosiloxane in the total constituents of the silicone-modified resin is preferably 10 to 70% by weight, more preferably 20 to 50% by weight. When this content is less than the above lower limit, undesirably, the silicone-modified resin scarcely shows its properties. When it exceeds the above upper limit, undesirably, the silicone-modified resin shows the properties similar to those of a silicone rubber formed of polyorganosiloxane alone.

The content of the silicone-modified resin in the image receptor layer is properly 0 to 50% by weight depending upon the kind of the silicone-modified resin, while it is preferably 1 to 20% by weight. When the content of the silicone-modified resin exceeds the above upper limit, the image-receiving performance may decrease.

The thermal transfer image receptor sheet is white or transparent, and further it can be colored in a variety of colors. That is, the image receptor layer can be formed on a colored plastic sheet such as a plastic sheet containing a pigment or a plastic sheet whose one surface is colored by printing or vapor deposition. Further, the image receptor layer containing a coloring material can be formed on a white or transparent plastic film. When white or transparent plastic sheets are used, there can be obtained thermal transfer image receptor sheets having various colors by incorporating coloring materials into image receptor layers.

The coloring material includes those generally used for producing inks. That is, it is selected from pigments such as carbon black, aniline black, titanium oxide, phthalocyanine pigments, monoazo pigments, disazo pigments, nitro pigments, nitroso pigments, perylene pigments, isoindolinone pigments and quinacridone pigments, and dyes such as azo dyes, anthraquinone dyes and nigrosine dyes. For an image transfer product having excellent weatherability, particularly preferred are pigments such as carbon black, fast yellow, cadmium yellow, yellow iron oxide, chromophthal yellow, anthrapyrimidine yellow, isoindolinone yellow, copper azomethine yellow, benzoimidazolone yellow, quinophthalone yellow, nickel dioxine yellow, flavanthrone yellow, chrome yellow, titanium yellow, disazo yellow, benzimidazolone orange, pyranthrone orange, perynone orange, para red, lake red, naphthol red, pyrazolone red, permanent red, madder lake, thioindigo Bordeaux, red iron oxide, red lead, cadmium red, quinacridone magenta, perylene barmillion, perylene red, chromophthal scarlet, anthrone red, dianthraquinolyl red, perylene maroon, benzoimidazolone carmine, perylene scarlet, quinacridone red, pyranthrone red, manganese violet, dioxazine violet, phthalocyanine blue, iron blue, cobalt blue, ultramarine, tndanthrone blue, phthalocyanine green, pigment green, nickelazo yellow, chromium oxide, viridian, benzoimidazolone brown, bronze powder, white lead, zinc white, lithopone, titanium oxide and a pearl pigment. A fluorescent pigment may be used as required.

Further, for improving the weatherability, the image receptor layer may contain an ultraviolet light absorbent and an ultraviolet light shielding agent. Examples of the ultraviolet light absorbent include compounds which absorb light having a wavelength of 290 to 400 nm, such as benzophenone compounds, benzotriazole compounds, salicylic acid phenyl ester compounds, cyanoacrylate compounds, cinnamic acids and aminobutadiene compounds. Examples of the ultraviolet light shielding agent include fine particles of titanium oxide, zinc white, talc, kaolin, calcium carbonate and iron oxide.

Further, for adjusting the coatability and coating properties, the image receptor layer may contain other additives such as a dispersing agent, an antistatic agent, a plasticizer and an antioxidant.

Examples of the antistatic agent include polyoxyethylene alkylamine, polyoxyalkylamide, polyoxyethylene alkyl ether, glycerin fatty acid ester, sorbitan fatty acid ester, alkyl sulfonate, alkylbenzenesulfonate, alkylsulfate, alkylphosphate and quaternary ammonium sulfate. In particular, the antistatic agent has an effect on the prevention of electrostatically collected dust which causes drop-out (voids) in thermal transfer recording.

Examples of the plasticizer include low molecular weight ester-containing plasticizers obtained from monohydric or polyhydric alcohol compounds and carboxylic acid compounds such as phthalic acid, isophthalic acid, tetrahydrophthalic acid, adipic acid, sebacic acid, maleic acid, fumaric acid, trimellitic acid and oleic acid, alkyd plasticizers and oxirane oxygen-containing epoxy type plasticizers.

The substrate is preferably selected from 10 to 500 μm thick plastic sheets formed of synthetic paper, polyester, polyvinyl chloride, polyurethane, poly(meth)acrylate, polycarbonate, polyethylene, polypropylene, polyamide and cellulose. In view of weatherability, flexibility and aesthetically fine appearance, preferred are 50 to 500 μm thick plastic sheets formed of soft polyvinyl chloride, polyester and synthetic paper. Further, an adhesive layer may be formed between the image receptor layer and the substrate for improving the adhesion of the two members.

The image receptor layer can be formed on the substrate by a solvent coating method in which a composition for forming the image receptor layer is dissolved in a solvent and the resultant solution is coated and dried or by a hot melt coating method in which a composition for forming the image receptor layer is melted under heat to coat the image receptor layer. The thickness of the image receptor layer is preferably approximately 0.1 to 10 μm. For forming the image receptor layer having a small thickness, the solvent coating method is preferred, and for forming the image receptor layer having a large thickness, the hot melt coating method is preferred. It is more preferred to form an image receptor layer having a thickness of approximately 0.2 to 2 μm by the solvent coating method.

EXAMPLES

The present invention will be explained more in detail hereinafter with reference to Examples, in which "part" stands for "part by weight".

Example 1

One surface of a soft vinyl chloride sheet having a thickness of 100 μm was coated with a coating liquid containing the following components by a gravure coating method to form a coating having a thickness of 1 μm, whereby an image receptor sheet was obtained.

| | |
|---|---|
| Sucrose benzoate (Monopet SB, supplied by Dai-Ichi Kogyo Seiyaku Co., Ltd.) | 15 parts |
| Polyurethane resin (Desmocoll 530, Sumitomo-Bayer Urethane Co., Ltd.) | 5 parts |
| Toluene | 40 parts |
| Methyl ethyl ketone | 40 parts |

Example 2

One surface of a polyethylene terephthalate sheet having a thickness of 100 μm was coated with a coating liquid containing the following components in the same manner as in Example 1, whereby an image receptor sheet was obtained.

| | |
|---|---|
| Sucrose benzoate (Monopet SB, supplied by Dai-Ichi Kogyo Seiyaku Co. Ltd.) | 12 parts |
| Polyester resin (Vylon 200, supplied by Toyobo Co., Ltd.) | 8 parts |
| Toluene | 40 parts |
| Methyl ethyl ketone | 40 parts |

Example 3

One surface of a soft vinyl chloride sheet having a thickness of 100 μm was coated with a coating liquid containing the following components in the same manner as in Example 1, whereby an image receptor sheet was obtained.

| | |
|---|---|
| Sucrose benzoate (Monopet SB, supplied by Dai-Ichi Kogyo Seiyaku Co. Ltd.) | 12 parts |
| Polyester resin (Vylon 290, supplied by Toyobo Co., Ltd.) | 5 parts |
| Silicone-modified acrylic resin (Symac US350, supplied by Toagosei Chemical Industry Co., Ltd.) | 3 parts |
| Toluene | 40 parts |
| Methyl ethyl ketone | 40 parts |

Example 4

One surface of a soft vinyl chloride sheet having a thickness of 100 μm was coated with a coating liquid containing the following components in the same manner as in Example 1, whereby an image receptor sheet was obtained.

| | |
|---|---|
| Sucrose benzoate (Monopet SB, supplied by Dai-Ichi Kogyo Seiyaku Co. Ltd.) | 13 parts |
| Polyurethane resin (Desmocoll 530, Sumitomo-Bayer Urethane Co., Ltd.) | 4 parts |
| Silicone-modified urethane resin (Daiaromer SP2105, supplied by Dainichiseika Color & Chemicals Mfg., Co., Ltd.) | 3 parts |
| Toluene | 40 parts |
| Methyl ethyl ketone | 40 parts |

Example 5

One surface of a polyethylene terephthalate sheet having a thickness of 100 μm was coated with a coating liquid containing the following components in the same manner as in Example 1, whereby an image receptor sheet was obtained.

| | |
|---|---|
| Sucrose benzoate (Monopet SB, supplied by Dai-Ichi Kogyo Seiyaku Co. Ltd.) | 13 parts |
| Polyurethane resin (Desmocoll 530, Sumitomo-Bayer Urethane Co., Ltd.) | 4 parts |
| Fluorine-containing resin (Surflon S381, supplied by Asahi Glass Co., Ltd.) | 3 parts |
| Toluene | 40 parts |
| Methyl ethyl ketone | 40 parts |

Comparative Example 1

One surface of a soft vinyl chloride sheet having a thickness of 100 μm was coated with a coating liquid containing the following components in the same manner as in Example 1, whereby an image receptor sheet was obtained.

| | |
|---|---|
| Epoxy resin (Epikote 1002, supplied by Yuka Shell Epoxy K.K.) | 20 parts |
| Toluene | 40 parts |
| Methyl ethyl ketone | 40 parts |

Comparative Example 2

One surface of a polyethylene terephthalate sheet having a thickness of 100 μm was coated with a coating liquid containing the following components in the same manner as in Example 1, whereby an image receptor sheet was obtained.

| | |
|---|---|
| Polyester resin (Vylon 200, supplied by Toyobo Co., Ltd.) | 20 parts |
| Toluene | 40 parts |
| Methyl ethyl ketone | 40 parts |

The image receptor sheets prepared in Examples and Comparative Examples were tested as follows. The image receptor layer surface and the heat melting ink surface (prepared by forming a heat-resistant layer on one surface of a 6 μm thick polyethylene terephthalate film, providing the other surface of the film with a peel layer and then forming a heat-melting ink layer composed mainly of an acrylic resin and a pigment) were brought into contact, and these two sheets were heated from the heat-resistant layer surface with a thermal head to obtain an image transfer product. For the image-receiving performance of the image receptor, the resolution was visually evaluated. The adhesion of the image receptor sheet to the heat melting ink was evaluated by attaching a cellophane tape to the heat melting ink surface of the image transfer product and peeling the cellophane tape off rapidly. The scratch resistance was evaluated by a pencil hardness test (JIS K-5401) on the heat melting ink side. The abrasion resistance was evaluated by a coloring fastness to rubbing test (JIS K-0823) on the heat melting ink side. The outdoor weatherability was evaluated by fixing the image transfer product to an outdoor exposure tester, exposing it for 6 months and then assessing the degree of contamination.

Table 1 shows the results.

TABLE 1

| | Image-receiving performance | Adhesion | Scratch resistance | Abrasion resistance | Outdoor weather-ability |
|---|---|---|---|---|---|
| Ex. 1 | A | A | A | A | A |
| Ex. 2 | A | A | A | A | A |
| Ex. 3 | A | A | A | A | A |
| Ex. 4 | A | A | A | A | A |
| Ex. 5 | A | A | A | A | A |
| CEx. 1 | A | B | B | B | C |
| CEx. 2 | B | B | A | A | A |

Ex. = Example,
CEx. = Comparative Example
A = Excellent
B = Poor
C = Defective

As shown in Table 1, the image receptor sheets prepared in Examples 1 to 5 showed excellent results in all the tests due to the effect of sucrose benzoate. On the other hand, the image receptor sheet prepared in Comparative Example 1 showed excellent image receiving performance since the thermoplastic resin used in the image receptor layer had a sharp reel ting point (80° C.), while the image transfer product was poor in adhesion, scratch resistance and abrasion resistance since it had poor film formability, and further the image transfer product was weathered due to deterioration in the weatherability test since the thermoplastic resin had a low molecular weight and was hence poor in weatherability. The image transfer product using the image receptor sheet obtained in Comparative Example 2 was excellent in scratch resistance and abrasion resistance since the thermoplastic resin used in the image receptor layer had high film formability, while the image receptor sheet was poor in image receiving performance and adhesion since the thermoplastic resin had a high softening point (160° C.), although the image transfer product was excellent in weatherability owning to the above high softening point.

What is claimed is:

1. A thermal transfer image receptor sheet for use in a heat-melting thermal transfer method, said receptor sheet comprising a substrate and an image receptor layer formed thereon, wherein the image receptor layer comprises 1 to 99% by weight of sucrose benzoate and 99 to 1% by weight of a thermoplastic resin, and wherein the thermoplastic resin includes a fluorine-containing resin having a polyfluoro group or a silicone-modified resin having a polyorganosiloxane unit in an amount of 1 to 50% by weight based on the weight of the image receptor layer.

2. A thermal transfer image receptor sheet according to claim 1, wherein the thermoplastic resin includes the fluorine-containing resin in the image receptor layer in an amount of 1 to 20% by weight.

3. A thermal transfer image receptor sheet according to claim 1, wherein the thermoplastic resin includes the silicone-modified resin in the image receptor layer in an amount of 1 to 20% by weight.

4. A thermal transfer image receptor sheet for use in a heat-melting thermal transfer method, said receptor sheet comprising a substrate and an image receptor layer formed thereon, wherein the image receptor layer consists essentially of 1 to 99% by weight of sucrose benzoate and 99 to 1% by weight of a thermoplastic resin.

* * * * *